US008516675B2

(12) United States Patent
Evans et al.

(10) Patent No.: US 8,516,675 B2
(45) Date of Patent: Aug. 27, 2013

(54) METHOD OF FORMING A GOLF CLUB HEAD WITH IMPROVED AERODYNAMIC CHARACTERISTICS

(75) Inventors: D. Clayton Evans, San Marcos, CA (US); Evan D. Gibbs, Encinitas, CA (US); Matthew T. Cackett, San Diego, CA (US); Steven M. Ehlers, Poway, CA (US)

(73) Assignee: Callaway Golf Company, Carlsbad, CA (US)

( * ) Notice: Subject to any disclaimer, the term of this patent is extended or adjusted under 35 U.S.C. 154(b) by 345 days.

(21) Appl. No.: 13/024,122

(22) Filed: Feb. 9, 2011

(65) Prior Publication Data

US 2011/0192002 A1 Aug. 11, 2011

Related U.S. Application Data

(60) Provisional application No. 61/303,178, filed on Feb. 10, 2010.

(51) Int. Cl.
*B23Q 17/00* (2006.01)

(52) U.S. Cl.
USPC ..... 29/407.05

(58) Field of Classification Search
USPC ..... 29/407.01, 407.05, 407.1; 473/324–350
See application file for complete search history.

(56) References Cited

U.S. PATENT DOCUMENTS

| | | | | |
|---|---|---|---|---|
| 7,163,468 | B2 | 1/2007 | Gibbs et al. | |
| 7,163,470 | B2 | 1/2007 | Galloway et al. | |
| 7,166,038 | B2 | 1/2007 | Williams et al. | |
| 7,214,143 | B2 | 5/2007 | Deshmukh | |
| 7,252,600 | B2 | 8/2007 | Murphy et al. | |
| 7,258,626 | B2 | 8/2007 | Gibbs et al. | |
| 7,258,631 | B2 | 8/2007 | Galloway et al. | |
| 7,273,419 | B2 | 9/2007 | Evans et al. | |
| 8,241,142 | B2 * | 8/2012 | Evans et al. | 473/345 |
| 8,317,636 | B2 * | 11/2012 | Evans et al. | 473/345 |
| 2011/0192001 | A1 * | 8/2011 | Evans et al. | 29/407.01 |
| 2011/0195801 | A1 * | 8/2011 | Evans et al. | 473/345 |

* cited by examiner

*Primary Examiner* — John C Hong
(74) *Attorney, Agent, or Firm* — Sonia Lari; Michael A. Catania; Rebecca L. Hanovice

(57) ABSTRACT

A method for forming a driver type golf club head, the method comprising orienting a golf club head using a largest tangent circle method, forming a golf club head having an apex point positioned in a crown apex zone and designing a crown curve having some portion exist above a 5.25 inch radius arc, the radius arc beginning at the apex point and extending rearward toward the back end of the golf club head.

6 Claims, 5 Drawing Sheets

METHOD OF FORMING A GOLF CLUB HEAD WITH IMPROVED AERODYNAMIC CHARACTERISTICS

CROSS REFERENCES TO RELATED APPLICATIONS

This application claims priority to U.S. Provisional Patent Application No. 61/303,178 filed on Feb. 10, 2010.

STATEMENT REGARDING FEDERALLY SPONSORED RESEARCH OR DEVELOPMENT

Not Applicable

BACKGROUND OF THE INVENTION

1. Field of the Invention

The present invention relates to a method for reducing the effects of drag force when using a driver.

2. Description of the Related Art

The prior art discloses various designs to reduce the drag force to improve driver performance.

The prior art fails to provide a driver with designs that efficiently reduce drag forces and consequentially enable the driver to be swung faster along its path and contribute to an improved impact event with the golf ball.

The United States Golf Association (USGA) has increasingly limited the performance innovations of golf clubs, particularly drivers. Recently, the USGA has limited the volume, dimensions of the head, such as length, width, and height, face compliance, inertia of driver heads and overall club length. Current methods previously used to improve the performance of a driver have been curtailed by limitations on design parameters set by the USGA. An area of driver performance improvement that exists, as of this date, is the potential to reduce the drag force that opposes the driver's travel through the air during its path to the golf ball on the tee. A reduction in drag force would allow the driver club head to travel faster along its path and contribute to an improved impact event with the golf ball, resulting in higher golf ball velocities and consequentially, in longer golf shots.

The purpose of this invention is to effectively incorporate several design features in the driver club head that will enable lower drag coefficients as the driver is swung by a golfer. The design features will reduce drag forces and consequently allow the driver to be swung faster than conventional driver designs that currently exist. By improving the drag coefficients of the crown and sole surfaces and lowering the overall drag forces that impede the driver club head from moving faster through the air, the head speed of the driver is increased by approximately 1 to 3 mph.

The recent past has shown that driver designs have trended to include characteristics to increase the driver's inertia values to help off-center hits go farther and straighter. Driver designs have also recently included larger faces, which may help the driver deliver better feeling shots as well as shots that have higher ball speeds if hit away from the face center. However, these recent trends may also be detrimental to the driver's performance due to the head speed reductions that these design features introduce due to the larger geometries. The design of the present invention allows for higher inertias and robust face design of current drivers in addition to a driver design that will lower the drag forces on the club head and improve drag coefficients on the face, sole, and crown surfaces.

BRIEF SUMMARY OF THE INVENTION

The main objective of the present invention is to improve the aspect ratio of the driver club head and to improve driver club head crown surface design. To improve the aspect ration of the driver club head, a driver is created which has an increased depth, distance from the face to the most rearward point, while reducing the overall height. This design will improve air flow over the face and crown of the driver and minimize the overall projected area of the club head in the direction of the air flow. Improvements on the driver club head crown surface design include creating a driver having a crown surface that is flatter, less curvature, while combining it with an apex point location that is further away from the face to promote a more preferred air flow over the club head.

One aspect of the method of forming a golf club head of the present invention comprises orienting a golf club head using a largest tangent circle method and forming a golf club head having an apex point positioned in a crown apex zone, and designing a crown curve having some portion exist above a 5.25 inch radius arc, the radius arc beginning at the apex point and extending rearward toward the back end of the golf club head.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
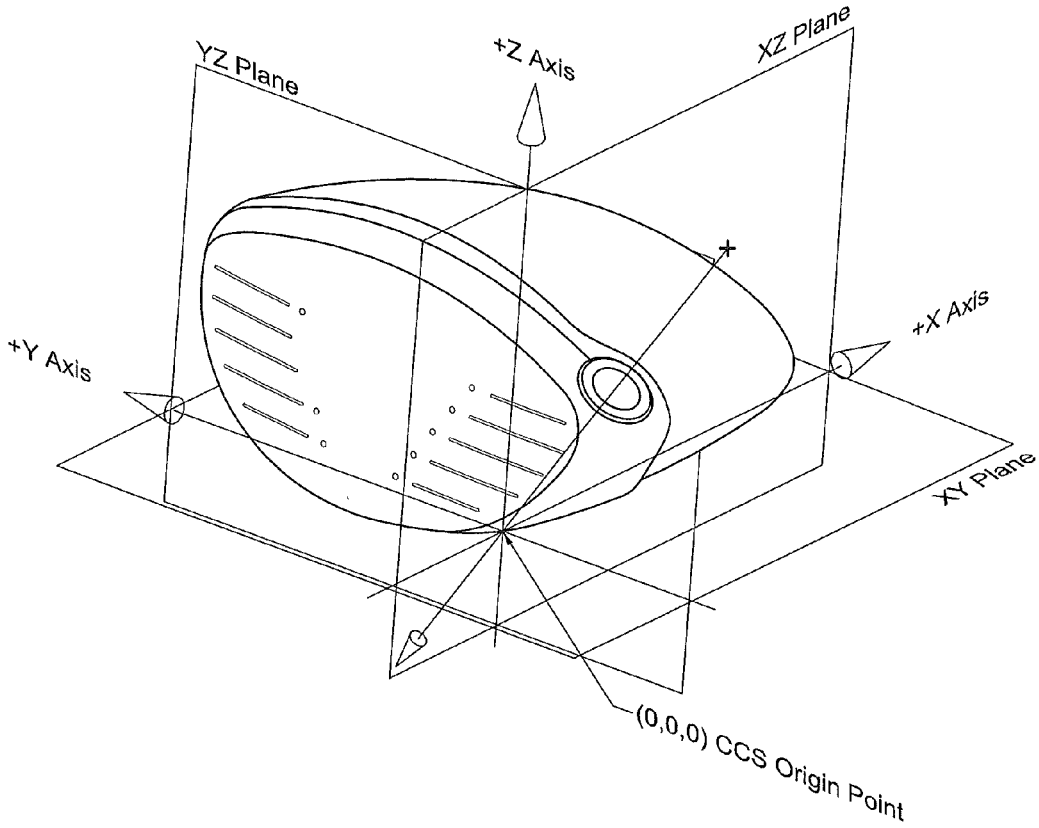
FIG. 1 is a perspective view of a golf club head superimposed on a cartesian coordinate system according to a method for designing a golf club head.

The present invention relates to the design relationships and methods of measurement comprising the improved aspect ratio of the driver golf club head 20 and the improved driver golf club head 20 crown 26 surface design. To verify the existence of conforming or non-conforming geometries of a driver club head 20, a method of measurement has been developed called the, "Largest Tangent Circle Method (LTCM)".

One aspect of the method of forming a golf club head 20 of the present invention comprises orienting a golf club head 20 using a largest tangent circle method and forming a golf club head 20 having an apex point 46, or highest point of the crown 26 surface, positioned in a crown apex zone 42, and designing a crown 26 curve having some portion exist above a 5.25 inch radius arc, the radius arc beginning at the apex point 46 and extending rearward toward the back end of the golf club head 20.

Preferably, the driver type golf club head 20 has a volume of less than 400 cubic centimeters. Preferably, the body 22 is composed of a stainless steel material. In one embodiment, the sole 28 is composed of a metal material and the crown 26 is composed of a non-metal material. Alternatively, the body 22 is composed of a titanium alloy material.

Figure 3:
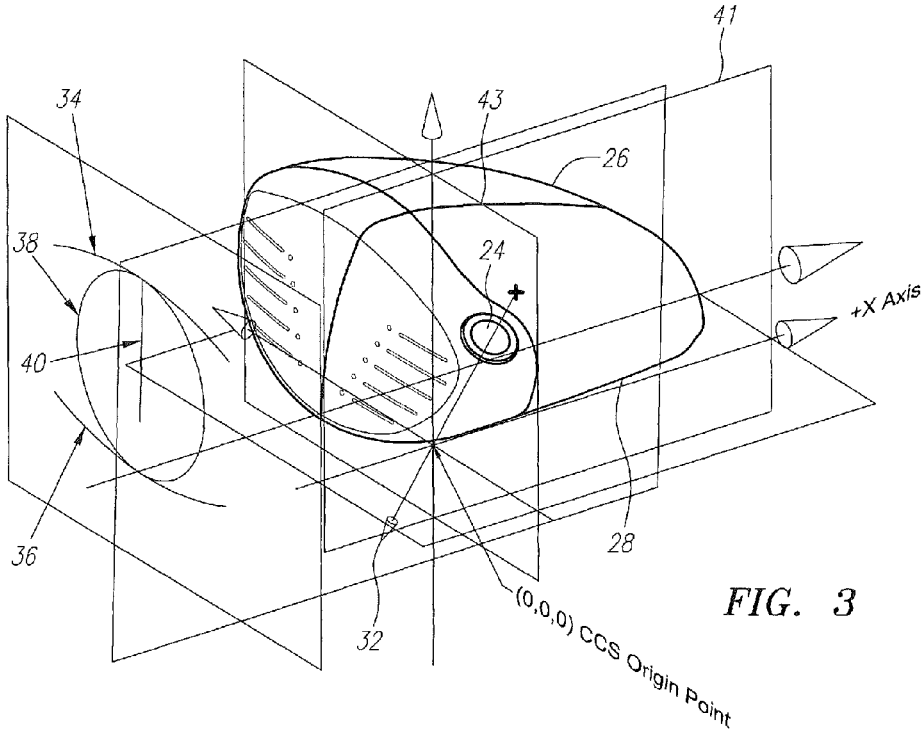
FIG. 3 is a perspective view of a golf club head superimposed on a cartesian coordinate system according to a method for designing a golf club head.

The LTCM orientation is achieved by bringing the golf club head 20 into a Cartesian Coordinate System (CCS) space where three perpendicular planes exist. The point at which all three planes intersect each other is called the origin point, as shown in FIG. 3. The resulting lines of intersection of the three planes with each other are perpendicular lines representing the CCS, with each line or axis being labeled appropriately X, Y, and Z and pass through the origin point. The values on either side of the origin of the X, Y, and Z axis are labeled either positive or negative, as defined and understood in the CCS.

The driver golf club head 20 is oriented in such a manner such that the hosel axis line 32 lies in the YZ plane and passes through the origin point of the CCS.

The driver golf club head 20 is further oriented such that the hosel axis line 32 of the golf club head 20 lies at an angle equal to its designed lie angle from the −Y axis rotating around the origin point towards the +Z axis, using the right-hand rule with the thumb pointing in the −X direction.

As shown in FIG. 1, the golf club head 20 is further oriented by pivoting it around the hosel axis line 32 until a point or edge on the sole 28 is tangent to a plane parallel with the XY plane that has the greatest intersection point value on the Z axis.

Figure 2:
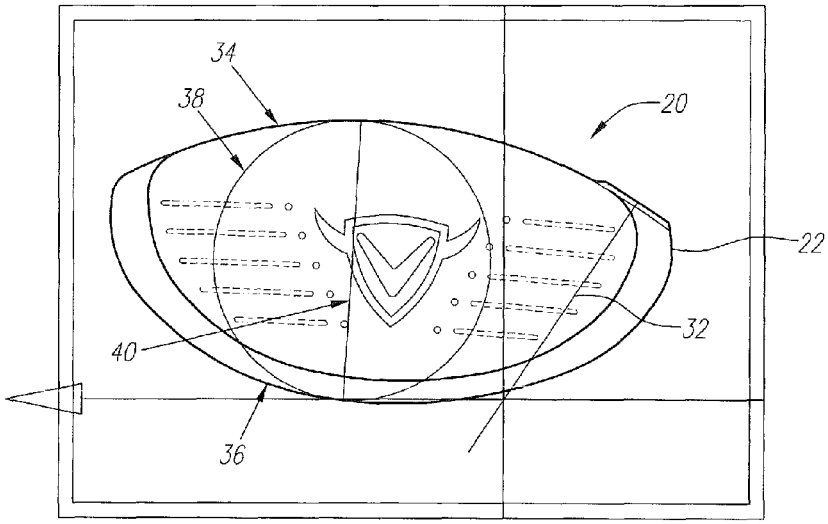
FIG. 2 is a perspective view of a golf club head placed into a cartesian coordinate system showing the largest tangent circle method according to a method for designing a golf club head.

In this embodiment, when the golf club head 20 is viewed along the X axis, the crown silhouette curve 34 and the sole silhouette curve 36 are projected onto a measurement plane parallel to the YZ plane. A circle 38 is placed on the measurement plane between the projected crown silhouette curve 34 and the projected sole silhouette curve 36 and is enlarged until the circle 38 has the maximum diameter possible, preferably to the nearest 0.001 inch, and is tangent to both the projected crown silhouette curve 34 and the projected sole silhouette curve 36. As shown in FIG. 2, a tangent line 40 is created from the tangent point where the circle touches the projected crown silhouette curve 34 to the tangent point where the circle touches the projected sole silhouette curve 36.

As shown in FIG. 3, a cross sectional curve 43, of the golf club head 20 is obtained by orienting a plane 41 though the tangent line 40 connecting the tangent points and rotating the plane through the tangent line 40 so the cross section curve 43 is created with the XY plane that is parallel with the X axis of the CCS.

Figure 4:
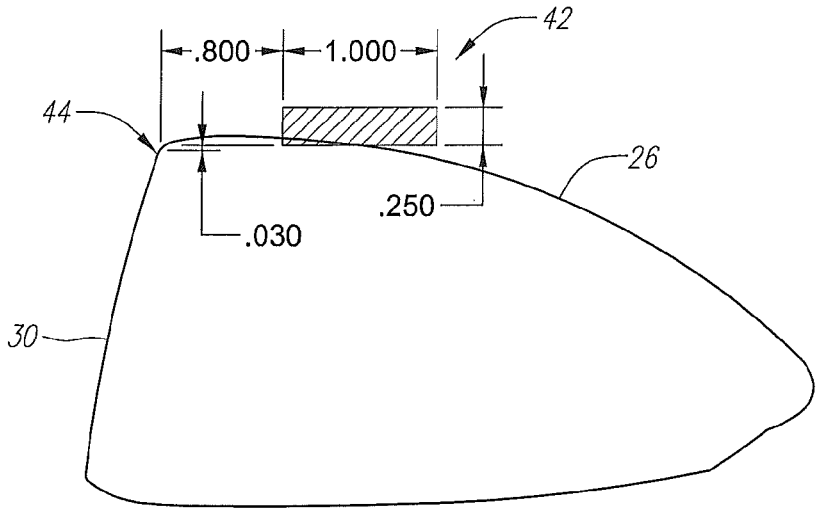
FIG. 4 is a 2D cross sectional view showing the endpoint of intersection of a golf club head.

As shown in FIG. 4, the created and oriented plane is used to intersect the golf club head 20 to obtain 2D cross-sectional views showing the crown 26 contour of the driver type golf club head 20. An area encompassed by a rectangle having a preferred height of 0.25 inch and a preferred length of 1.00 inch, is positioned approximately 0.030 inch above, in the +Z direction, and 0.800 inch to the right, in the +X direction, of the uppermost intersection curve with the face 30 of the golf club head 20.

The rectangular area, or crown apex zone 42, is an important zone for the surface of the crown 26 of the golf club head 20, and has its highest point, the apex point 46. It is further away from the face 30 of the golf club head 20, in the +X direction, and relatively not too high above the upper edge of the face 30, in the +Y direction. When the apex point 46 of the surface of the crown 26 falls within this zone 42, the airflow moving across the surface of the crown 26 of the golf club head 20 has been shown to remain laminar and reduce the drag of the driver type golf club head 20. In addition to the design of the surface of the crown 26 with the apex point 46 in the rectangular zone 42, the flatness of the contour of the crown 26 and the depth of the golf club head 20 aid in reducing the drag of the club head 20. It has been shown by Computational Fluid Dynamic (CFD) studies that the flatter the portion of the crown 26 of the club head 20, the longer the airflow across the crown 26 stays attached to the crown 26 without separating and becoming turbulent. Also, lower drag forces are promoted the longer the air can travel along the crown 26 before separating.

The new methods used to improve aerodynamic properties of a driver golf club head 20 involve the relationship that the apex point 46 on the crown 26 surface of a club head 20 has with other geometric features on the club head 20, such as its depth, height and curvature of the crown 26 surface. The present invention comprises two methods of enhancing the swing characteristics of a driver club head 20 by reducing the drag force.

Method #1). Improved Aspect Ratio of Driver Club Head.

The method of the present invention involves creating a driver type golf club head 20 that has an increased depth, distance from the face 30 to the most rearward point, while reducing its height. This improves air flow over the face 30 and crown 26 of the driver type golf club head 20, which minimizes the overall projected area of the club head 20 in the direction of the airflow.

Method #2). Improved Driver Club Head Crown Surface Design.

An alternative method of the present invention involves creating a driver type golf club head 20 having a crown 26 surface that is flatter, combined with an apex point 46 location that is further away from the face 30 to promote a more preferred air flow over the club head 20.

Driver type golf club heads 20 created using the methods discussed enable the golfer to benefit from an improved driver 20 design more suited to hitting shots with higher ball velocities due to the increased head speed produced by lower drag forces opposing the driver 20 as it travels through the air.

The feature of a flatter crown 26 surface reduces the drag of the air flow over the crown 26 in a more favorable manner if the apex point 46 of the crown 26 is within the crown apex zone 42 and the crown 26 surface does not drop off too rapidly. When the apex point 46 is positioned in the crown apex zone 42, and a flatter crown 26 curvature continues rearward, in the +X direction, the drag coefficients over the crown 26 surface are reduced resulting in lower drag forces. In addition, the longer the air flow can stay attached to the surface of the crown 26, without becoming separated, the lower the drag forces that are generated. Thus, club head 20 depths greater than 4.600 inches are preferred.

In conjunction with reducing the drag coefficient of the crown 26 surface, the projected area of the golf club head 20 is also reduced. The projected area is a variable in the drag equation, and the lower the area, the better opportunity exists to lower the overall drag of the club head 20. By using a club height, h, that is less than half the depth, d, of the club head 20, a projected area shape that is lower in overall area and shallower in aspect ratio is achieved in comparison to projected area shapes of drivers with deeper club heights. This minimizes the displacement of air molecules as they pass over and around the club head 20. For example if an air molecule hits the center of a driver club 20 face 20, the distance it has to travel up the face 20 and around the club head 20 is less if the face 30 height is shallower versus the distance it must travel on deeper face 30 driver 20.

Figure 5:
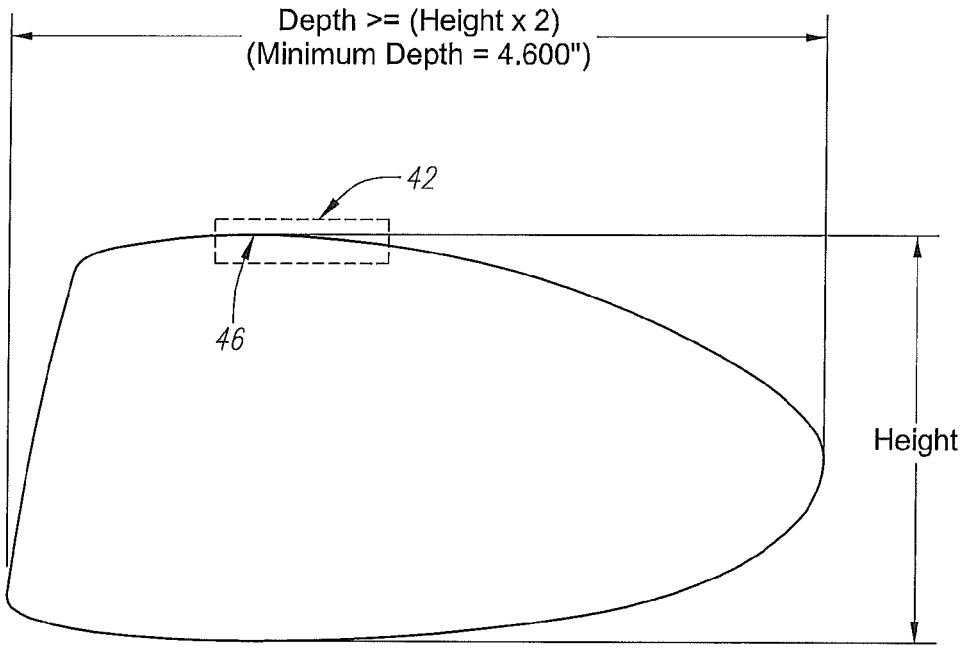
FIG. 5 is a 2D cross sectional view showing the crown apex zone of a golf club head.

As shown in FIG. 5, the apex of the crown 26 is located in the rectangular zone, or crown apex zone 42, and the depth, d, of the club head 20 must be at least twice the length as the height, h, of the club head 20 as measured in the plane defined by the LTCM method. The minimum depth, d, of the club head 20 must be equal or greater than 4.600 inch.

Figure 6:
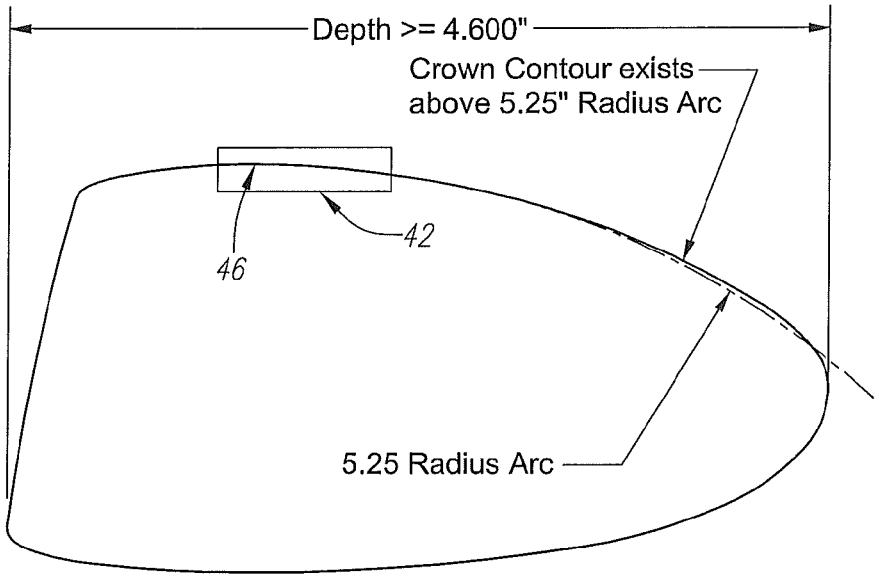
FIG. 6 is a 2D cross sectional view showing a radius arc above 5.25 inches of a golf club head.

As shown in FIG. 6, using the cross-section of a driver club head 20 derived using the LTCM method with the apex point 46 of the crown located within the crown apex zone 42, the curve of the crown 26 is designed to have some portion exist above a 5.25 inch radius arc that begins at the apex point 46 of the curve of the crown 26 and runs towards the back end of the club head 20, in the +X direction.

In a preferred embodiment, a driver type golf club head 20 formed using the method of the present invention comprises a body 22 having a face 30, a crown 26 and a sole 28, wherein the crown 26 is located in a crown apex zone 42. The club head 20 has a depth, d, the depth being at least twice the length as a height of the club head, wherein the depth is at least 4.600 inches.

The driver type golf club head 20 preferably has a volume of less than 400 cubic centimeters. The body 22 is preferably composed of a stainless steel material. The sole 28 is preferably composed of a metal material and the crown 26 is preferably composed of a non-metal material. The body 22 is alternatively composed of a titanium alloy material.

Figure 7:
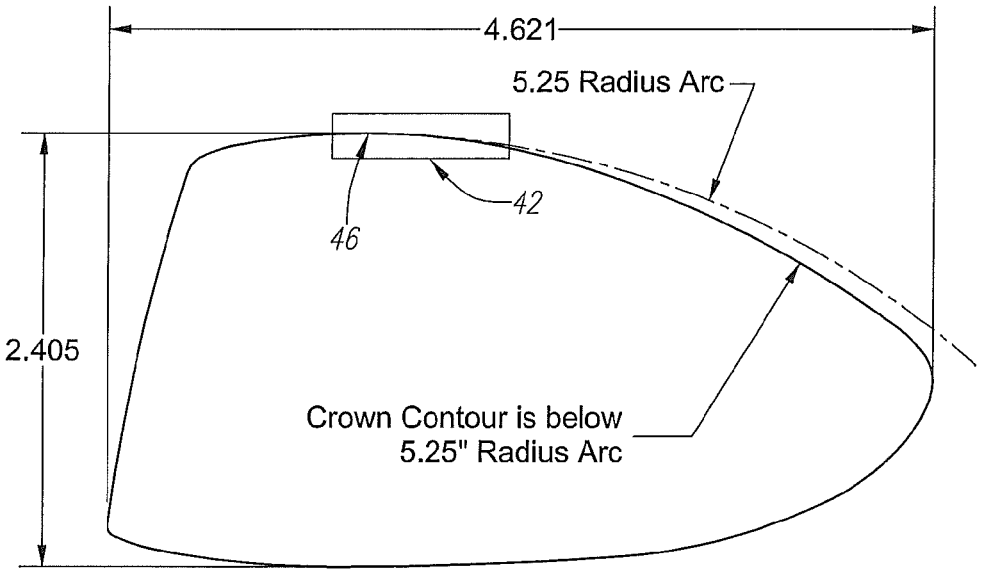
FIG. 7 (Prior Art)
FIG. 7 is a 2D cross sectional view of a golf club in the prior art.
Figure 8:
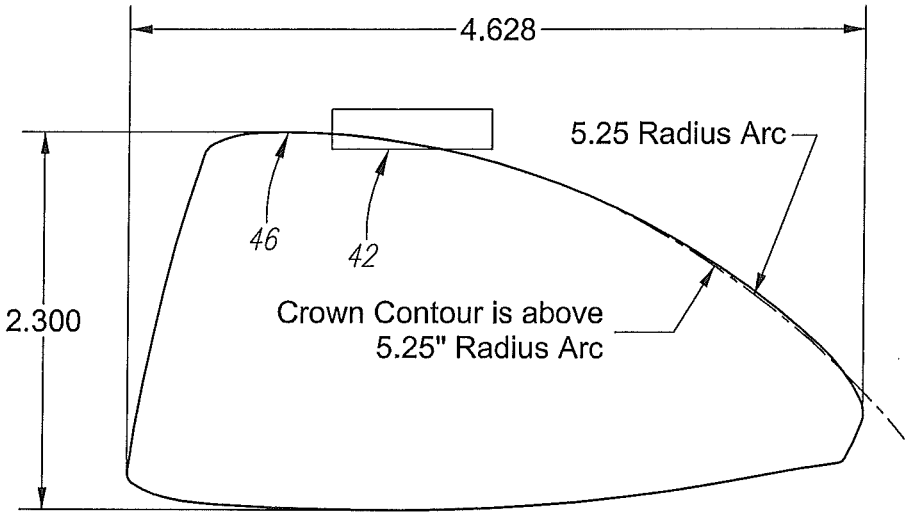
FIG. 8 (Prior Art)
FIG. 8 is a 2D cross sectional view of an alternative golf club in the prior art.
Figure 9:
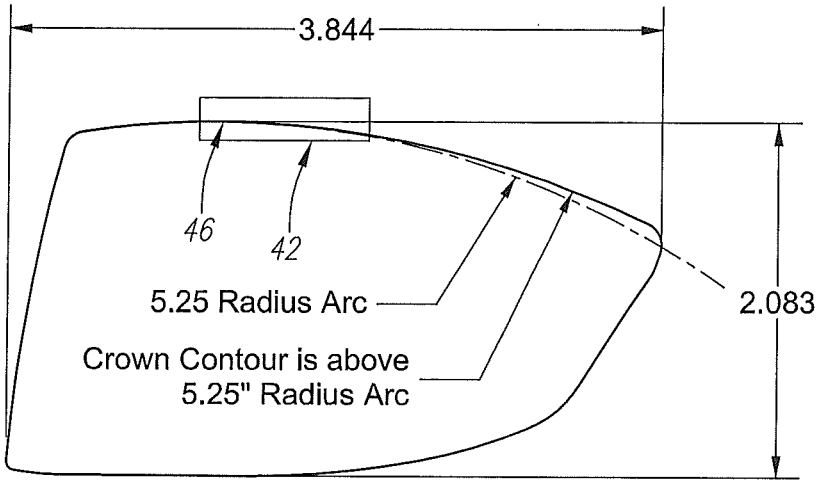
FIG. 9 (Prior Art)
FIG. 9 is a 2D cross sectional view of a second alternative golf club in the prior art.

For comparison purposes, FIG. 7-9 show golf club heads in the prior art, wherein the design features do not comply with the parameters set forth in the method of the present invention. In FIG. 7, the apex of the crown is located within the desired crown apex zone 42, the height is more than 50% of the depth. FIG. 8 shows a golf club head of the prior art wherein the apex point 46 of the crown does not lie within the crown apex zone 42. And lastly, FIG. 9 shows an alternative golf club in the prior art wherein the depth of the club is not equal to or greater than 4.600 inches.

Gibbs, et al., U.S. Pat. No. 7,163,468 is hereby incorporated by reference in its entirety.

Galloway, et al., U.S. Pat. No. 7,163,470 is hereby incorporated by reference in its entirety.

Williams, et al., U.S. Pat. No. 7,166,038 is hereby incorporated by reference in its entirety.

Desmukh U.S. Pat. No. 7,214,143 is hereby incorporated by reference in its entirety.

Murphy, et al., U.S. Pat. No. 7,252,600 is hereby incorporated by reference in its entirety.

Gibbs, et al., U.S. Pat. No. 7,258,626 is hereby incorporated by reference in its entirety.

Galloway, et al., U.S. Pat. No. 7,258,631 is hereby incorporated by reference in its entirety.

Evans, et al., U.S. Pat. No. 7,273,419 is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A method for forming a driver type golf club head, the method comprising:

orienting a golf club head using a largest tangent circle method, wherein the largest tangent circle method comprises placing a club head into a Cartesian Coordinate System (CCS) comprising a X axis comprising a +X axis and a −X axis, a Y axis comprising a +Y axis and a −Y axis, and a Z axis comprising a +Z axis and a −Z axis, wherein three perpendicular planes exists, the three perpendicular planes being XY, YZ and XZ, and the three perpendicular planes intersecting at an origin point; the club head comprising a body, a hosel, a crown a sole and a face;

orienting a hosel axis line of the club head in the YZ plane passing through the origin point;

orienting the club head with the hosel axis line at an angle equal to a designed lie angle in relation to the −Y axis rotating around the +Z axis;

orienting the club head by pivoting the club head around the hosel axis line until a point on the sole is tangent to a plane parallel with the XY plane that has a greatest intersection point value on the Z axis;

viewing the club head along the X axis and projecting a crown silhouette curve and a sole silhouette curve onto a measurement plane which is parallel to the YZ plane;

placing a circle on the measurement plane between the projected crown silhouette curve and the projected sole silhouette curve, enlarging the circle until the circle has a maximum diameter;

creating a tangent line from a tangent point where the circle touches the projected crown silhouette curve to a tangent point where the circle touches the projected sole silhouette;

forming a golf club head having an apex point positioned in a crown apex zone; and designing a crown curve having some portion exist above a 5.25 inch radius arc, the radius arc beginning at the apex point and extending rearward toward a back end of the golf club head.

2. The method according to claim 1 wherein the driver type golf club head has a volume of less than 400 cubic centimeters.

3. The method according to claim 1 wherein the body is composed of a stainless steel material.

4. The method according to claim 1 wherein the sole is composed of a metal material and the crown is composed of a non-metal material.

5. The method according to claim 1 wherein the body is composed of a titanium alloy material.

6. A method for forming a driver type golf club head, the method comprising:

orienting a golf club head using a largest tangent circle method, wherein the largest tangent circle method comprises a club head into a Cartesian Coordinate System (CCS) comprising a X axis comprising a +X axis and a −X axis, a Y axis comprising a +Y axis and a −Y axis, and a Z axis comprising a +Z axis and a −Z axis, wherein three perpendicular planes exists, the three perpendicular planes being XY, YZ and XZ, and the three perpendicular planes intersecting at an origin point; the club head comprising a body, a hosel, a crown, a sole and a face;

orienting a hosel axis line of the club head in the YZ plane passing through the origin point;

orienting the club head with the hosel axis line at an angle equal to a designed lie angle in relation to the −Y axis rotating around the +Z axis;

orienting the club head by pivoting the club head around the hosel axis line until a point on the sole is tangent to a plane parallel with the XY plane that has a greatest intersection point value on the Z axis;

viewing the club head along the X axis and projecting a crown silhouette curve and a sole silhouette curve onto a measurement plane which is parallel to the YZ plane;

placing a circle on the measurement plane between the projected crown silhouette curve and the projected sole silhouette curve, enlarging the circle until the circle has a maximum diameter;

creating a tangent line from a tangent point where the circle touches the projected crown silhouette curve to a tangent point where the circle touches the projected sole silhouette;

forming a golf club head having an apex point positioned in a crown apex zone;

the golf club head having a volume of approximately 400 cubic centimeters; and designing a crown curve having some portion exist above a 5.25 inch radius arc, the radius arc beginning at the apex point and extending rearward toward a back end of the golf club head.

* * * * *